US008733582B2

(12) United States Patent
Fioritto et al.

(10) Patent No.: US 8,733,582 B2
(45) Date of Patent: May 27, 2014

(54) DRINKING ASSEMBLY WITH INTEGRAL STRAW

(76) Inventors: David Fioritto, Washington Township, MI (US); Domenic Belcastro, Shelby Township, MI (US)

( * ) Notice: Subject to any disclaimer, the term of this patent is extended or adjusted under 35 U.S.C. 154(b) by 0 days.

(21) Appl. No.: 13/231,420

(22) Filed: Sep. 13, 2011

(65) Prior Publication Data

US 2012/0061409 A1 Mar. 15, 2012

Related U.S. Application Data

(60) Provisional application No. 61/382,060, filed on Sep. 13, 2010.

(51) Int. Cl.
*A47G 19/22* (2006.01)
*B65D 77/28* (2006.01)

(52) U.S. Cl.
CPC ..... *A47G 19/2272* (2013.01); *B65D 2231/022* (2013.01); *B65D 77/286* (2013.01); *Y10S 206/813* (2013.01); *Y10S 206/804* (2013.01)
USPC ..... 220/708; 220/707; 220/709; 220/711; 206/467; 206/460; 206/813; 206/804; 222/77; 222/286

(58) Field of Classification Search
CPC ..... A47G 19/2272; B65D 2231/022; B65D 77/286
USPC ..... 206/515, 499–513, 467, 460, 813, 804; 220/707–711, 380, 521, 200, 705, 719, 220/714, 715, 4.27, 212, 906, 735, 609; 215/229, 236, 228, 1 A, 237, 389, 6, 215/309, 388, 902; 222/416, 484; 15/257.01, 210.1, 105, 246, 209.1, 211
See application file for complete search history.

(56) References Cited

U.S. PATENT DOCUMENTS

| | | | | |
|---|---|---|---|---|
| 1,213,961 | A | | 1/1917 | Shepard |
| 1,786,733 | A | * | 12/1930 | Benoit ..... 220/380 |
| 2,194,011 | A | | 3/1940 | Davidson |
| 2,581,516 | A | * | 1/1952 | Cohen ..... 229/103.1 |
| 2,800,265 | A | | 7/1957 | Pugh, Sr. |
| 2,838,220 | A | | 6/1958 | Oppenheimer et al. |
| 2,885,134 | A | | 5/1959 | Cohen |
| 3,406,868 | A | | 10/1968 | Rogers |
| 3,558,033 | A | | 1/1971 | Leeds |

(Continued)

*Primary Examiner* — Andrew Perreault
*Assistant Examiner* — James M Van Buskirk
(74) *Attorney, Agent, or Firm* — Dickinson Wright PLLC

(57) ABSTRACT

A cup (22) includes a base (26) and a wall (30) with an integral straw (36). A lid (24) includes a flange (52) for mating with the cup (22) to establish an assembled position of the drinking assembly (20). The lid (24) defines an orifice (66) aligned with the integral straw (36) in the assembled position, and a flexible straw (68) is disposed within the orifice (66). The flexible straw (68) has a nipple portion (70) extending to an inlet end (72) disposed in abutting relationship with the integral straw (36) in the assembled position to establish a compression fit between the flexible straw (68) and the integral straw (36). The lid (24) is also stackable with identical lids (24) and includes a cavity (60) extending between first and second ends (62, 64). The orifice (66) is disposed about one of the ends (64) and the cavity (60) has an open portion (90) disposed about the other of the ends (62) for receiving a nipple portion (70) of the identical lid (24) being stacked in alternating relationship.

11 Claims, 5 Drawing Sheets

(56) References Cited

U.S. PATENT DOCUMENTS

| | | | | | |
|---|---|---|---|---|---|
| 3,871,662 | A | | 3/1975 | Hepp et al. | |
| 3,921,889 | A | | 11/1975 | Gibbons | |
| 4,247,016 | A | | 1/1981 | Shaw | |
| 4,291,814 | A | | 9/1981 | Conn | |
| 4,485,963 | A | | 12/1984 | Panicci | |
| 4,589,569 | A | | 5/1986 | Clements | |
| 4,615,457 | A | * | 10/1986 | Harding | 220/708 |
| 4,732,303 | A | * | 3/1988 | Wang | 222/484 |
| 4,811,860 | A | | 3/1989 | Sorenson et al. | |
| 5,065,881 | A | | 11/1991 | Tarng | |
| 5,065,909 | A | | 11/1991 | Pino et al. | |
| 5,109,995 | A | * | 5/1992 | Lou | 215/388 |
| 5,150,815 | A | * | 9/1992 | Saklad | 220/708 |
| 5,265,757 | A | * | 11/1993 | Wu | 220/707 |
| 5,292,017 | A | | 3/1994 | Reifers | |
| 5,337,918 | A | * | 8/1994 | Wang | 220/708 |
| 5,361,934 | A | * | 11/1994 | Spence, Jr. | 220/707 |
| 5,423,476 | A | | 6/1995 | Ferrer | |
| 5,477,978 | A | | 12/1995 | Lo | |
| 5,520,304 | A | * | 5/1996 | Lin | 220/707 |
| D384,584 | S | * | 10/1997 | Kong | D9/447 |
| 5,687,872 | A | | 11/1997 | Nmngani | |
| 5,904,266 | A | * | 5/1999 | Tedeschi, Jr. | 220/521 |
| 5,908,123 | A | * | 6/1999 | Huggins | 213/223 |
| 6,155,478 | A | | 12/2000 | Yang | |
| 6,213,339 | B1 | | 4/2001 | Lee | |
| 6,227,403 | B1 | | 5/2001 | Kim | |
| 2003/0213718 | A1 | * | 11/2003 | Ducharme et al. | 206/503 |
| 2004/0046042 | A1 | | 3/2004 | Judd | |
| 2006/0070908 | A1 | * | 4/2006 | Raymundo et al. | 206/515 |
| 2006/0196895 | A1 | | 9/2006 | Trejo | |
| 2007/0170188 | A1 | | 7/2007 | Guillaume | |
| 2009/0159606 | A1 | * | 6/2009 | D'Amato | 220/781 |
| 2011/0139667 | A1 | * | 6/2011 | Burgess et al. | 206/515 |

* cited by examiner

FIG. 5
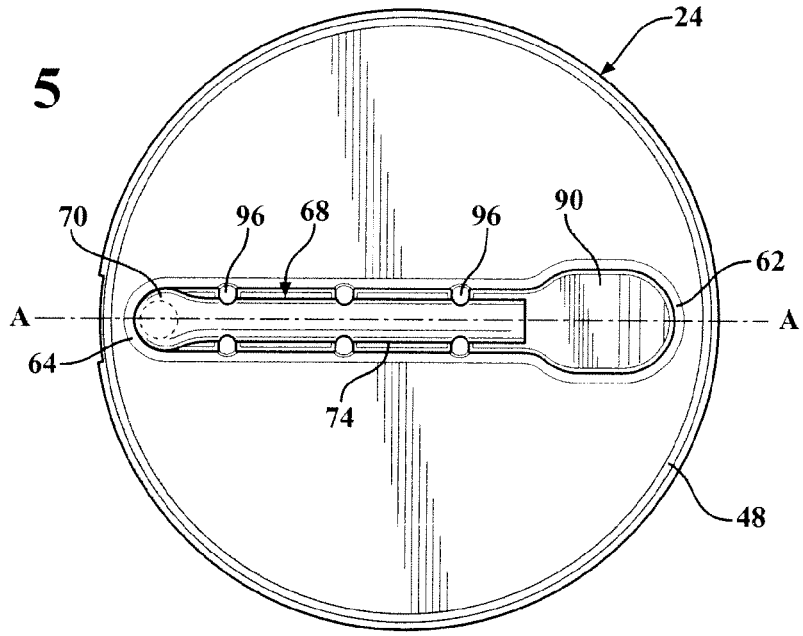
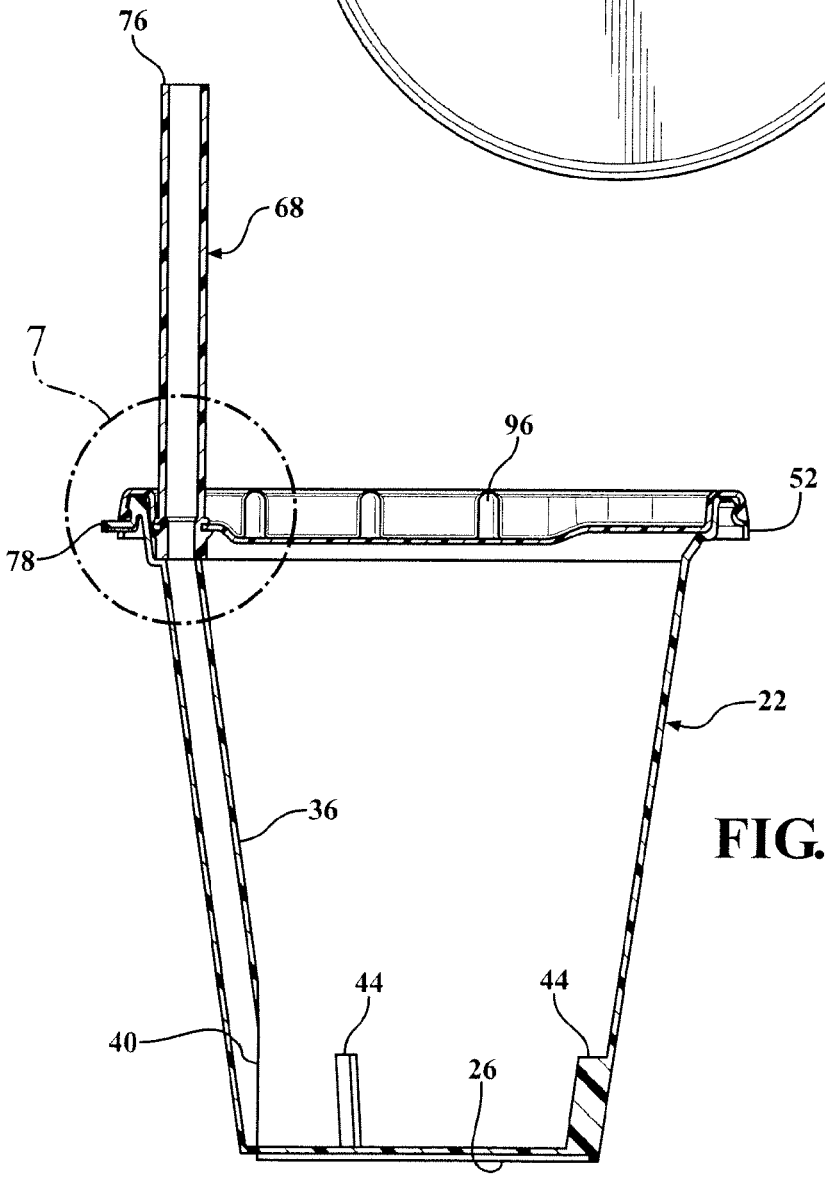
FIG. 6

DRINKING ASSEMBLY WITH INTEGRAL STRAW

CROSS REFERENCE TO RELATED APPLICATION

This application claims the benefit of provisional application Ser. No. 61/382,060 filed Sep. 13, 2010, entitled a "Drinking Cup with Integral Straw."

BACKGROUND OF THE INVENTION

1. Field of the Invention

The subject invention relates generally to a reusable and stackable drinking assembly including a cup having an integral straw and a lid for establishing an assembled position to contain a fluid.

2. Description of the Prior Art

The drinking assemblies to which the subject invention pertains are drinking assemblies which include a cup having a base and a wall extending upwardly from the base for receiving a fluid. An integral straw is disposed along the wall for conveying the fluid from the base, and a lid mates with the cup to establish an assembled position of the drinking assembly. In addition, the cups and lids of the drinking assemblies are each individually configured to allow for nesting and stacking with like or identical cups and lids.

Although the prior art drinking assemblies include cups having integral straws, there remains a need for a drinking assembly which provides a leak-proof and seal-proof design when the lid includes a flexible straw which mates with the integral straw in the assembled position. In addition, there remains a need for a design which establishes sealed fluid communication between the integral straw and the flexible straw. Also, while the prior art drinking assemblies are stackable, there remains a need for an improved lid design which is stackable when the lid includes the flexible straw.

SUMMARY OF THE INVENTION

The invention provides for the lid defining an orifice aligned with the integral straw in the assembled position, and a flexible straw disposed within the orifice and having a nipple portion extending to an inlet end disposed in abutting relationship with the integral straw in the assembled position to establish a compression fit between the flexible straw and the integral straw for sealing fluid communication therebetween.

The invention also provides for the lid being stackable and including a cavity extending downwardly from a top surface and between a first end and a second end. The orifice is disposed about one of the ends, and the nipple portion of the flexible straw extends downwardly from the orifice. The cavity has an open portion disposed about the other of the ends for receiving a nipple portion of the identical lid being stacked in 180 degree alternating relationship.

ADVANTAGES OF THE INVENTION

The drinking assembly allows a user to drink the fluid though a straw that is made up of an integral straw disposed on the cup and a flexible straw disposed on the lid. In addition, the flexible straw establishes a compression fit which provides for a spill-proof and leak-proof design allowing sealed fluid communication between the integral straw and the flexible straw. In addition, the nipple portion of the flexible straw establishes a unitary and sealed straw of the drinking assembly even though part of the straw is disposed on the cup and part of the straw is disposed on the lid. In addition, the stackable lid design facilitates an arrangement that is suitable for shipping while correspondingly saving space.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 5 is a top view of the lid illustrating the cavity extending downwardly from a top surface and along a cavity axis A for establishing a stored position of the flexible straw;

FIG. 6 is a cross sectional view of the drinking assembly disposed in the assembled position;

DETAILED DESCRIPTION OF THE ENABLING EMBODIMENTS

Figure 1:
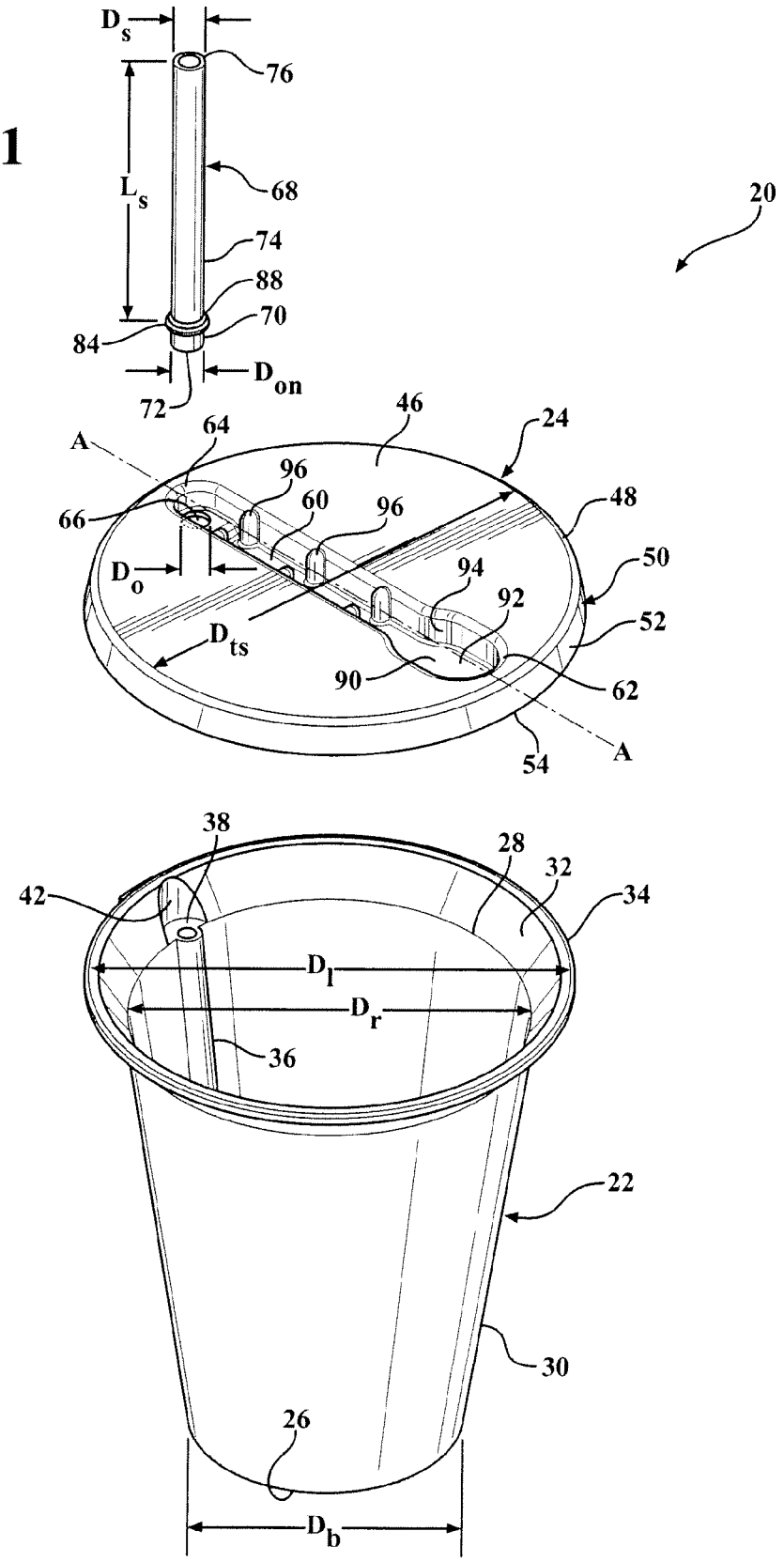
FIG. 1 is a perspective view of a drinking assembly illustrating a cup having an integral straw and a lid and a flexible straw.

Referring to the Figures, wherein like numerals indicate corresponding parts throughout the several views, a drinking assembly 20 includes a cup 22 and a lid 24 for containing a fluid. As discussed herein, the cup 22 and the lid 24 are each individually configured to allow for nesting and stacking with like or identical cups 22 and lids 24 for shipping purposes. In addition, the cup 22 and the lid 24 are configured to establish an assembled position of the drinking assembly 20 which allows a user to drink the fluid through a straw that is partially disposed on the cup 22 and partially disposed on the lid 24.

As best shown in FIG. 1, the cup 22 includes a base 26 being cylindrical and having a base diameter $D_b$ and a rim 28 being cylindrical and having a rim diameter $D_r$ larger than the base diameter $D_b$. A wall 30 extends therebetween and is tapered from the rim 28 towards the base 26 for receiving the fluid. The cup 22 includes a mouth portion 32 extending upwardly from the rim 28 and outwardly flared to a lip 34 having a lip diameter $D_l$ larger than the rim diameter $D_r$. In a preferred embodiment, the cup 22 includes an integral straw 36 molded along the wall 30 from an upper end 38 disposed adjacent the rim 28 to a lower end 40 disposed in spaced relationship with the base 26 for conveying the fluid from the lower end 40 to the upper end 38 of the integral straw 36. The cup 22 and integral straw 36 are preferably made of a plastic material, however, any other suitable materials can be utilized. The mouth portion 32 also defines a straw cut-out 42 disposed adjacent the upper end 38 of the integral straw 36 and extending from the rim 28 towards the lip 34 for providing access to the upper end 38 of the integral straw 36.

Figure 3:
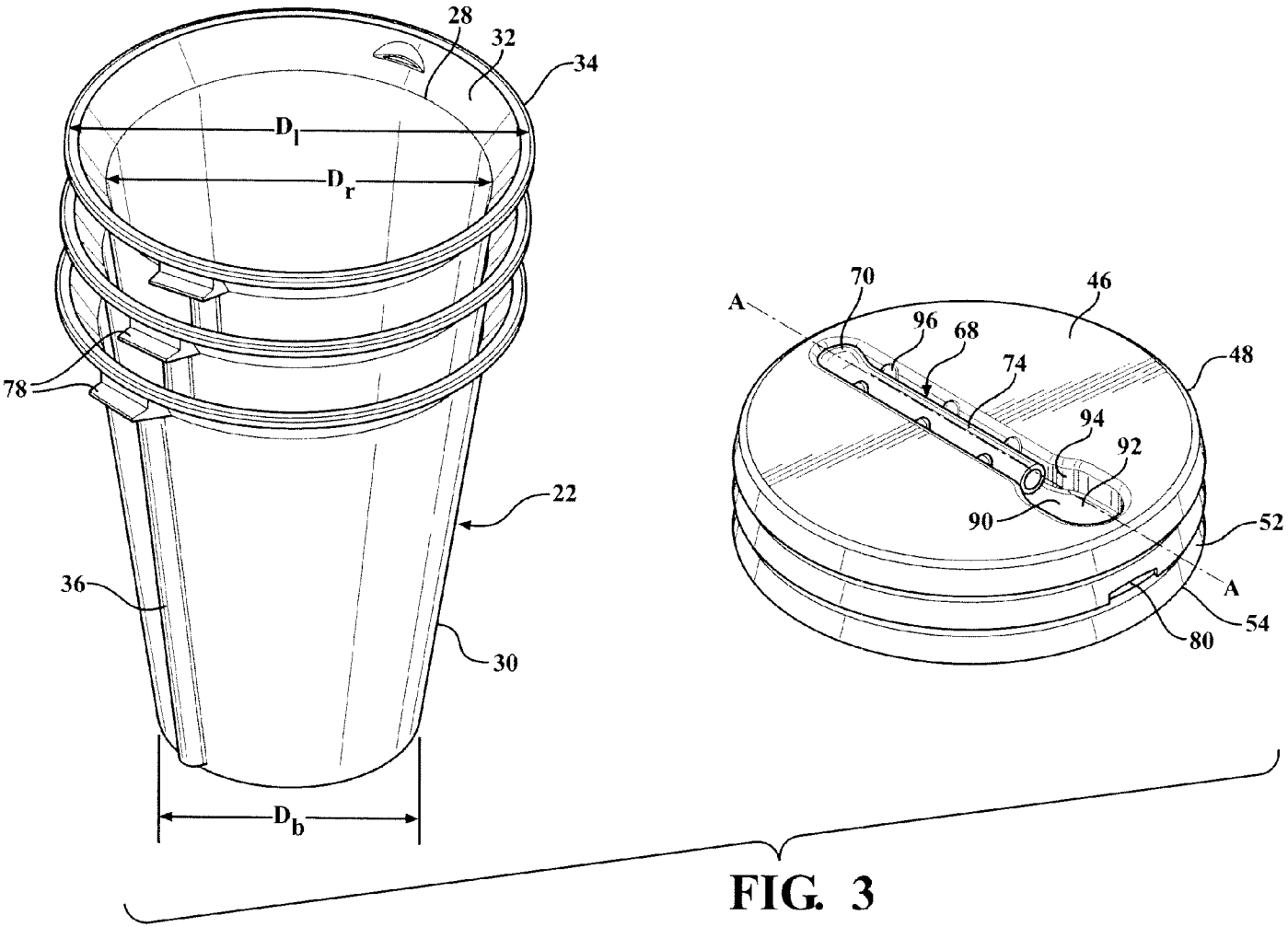
FIG. 3 is a perspective view of the cup and the lid disposed in a stacking relationship.

In a preferred embodiment and as best shown in FIG. 3, the cup 22 is a stackable cup and includes a plurality of stops 44 extending inwardly from the wall 30 and adjacent the base 26 for establishing abutting relationship with a base 26 of an identical cup 22 disposed in stacking relationship. In other words, when a plurality of cups 22 are disposed in stacking relationship, the stops 44 establish a spaced relationship between the bases 26 and the lips 34 of each stacked or adjacent identical cup 22. The ability of the cups 22 to be disposed in stacking relationship is advantageous because it facilitates an arrangement that is suitable for shipping while correspondingly saving space. As also shown in FIG. 3, in a stacking relationship of the cups 22, the integral straws 36 are disposed in staggered or offset relationship. However, in an alternative embodiment, the integral straw 36 can collapse upon itself to allow another cup 22 to fit therewithin.

Figure 2:
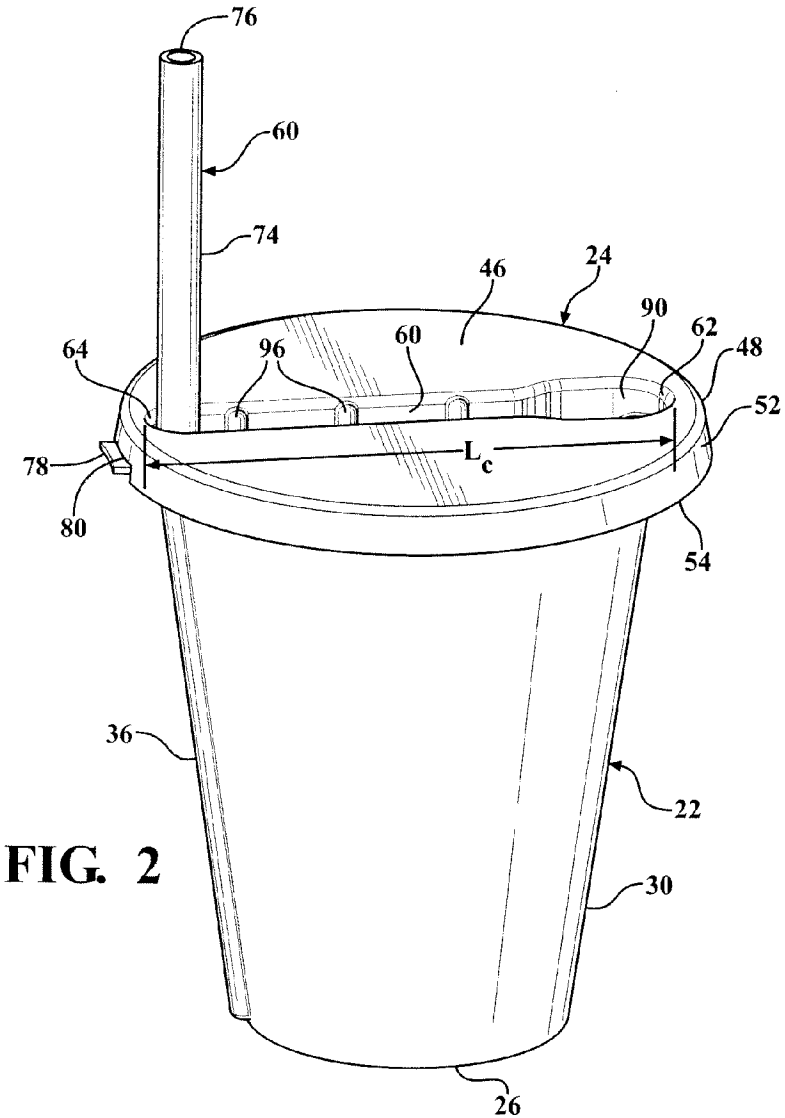
FIG. 2 is a perspective view of the drinking assembly in an assembled position.

As best shown in FIG. 1, the lid 24 includes a top surface 46 being cylindrical and having a top surface diameter $D_{ts}$ to define a top edge 48 of the lid 24. The lid 24 includes a locking mechanism 50 for mating with the cup 22 to establish an assembled position of the drinking assembly 20 wherein the lid 24 is disposed in interlocked relationship with the cup 22 to contain the fluid in the drinking assembly 20. In the preferred embodiment, the locking mechanism 50 includes a flange 52 disposed circumferentially about the top surface 46 and extending downwardly from the top edge 48, however any other locking mechanism 50 could be used such as clamps, tabs, or the like to interlock the lid 24 to the cup 22. In the preferred embodiment, the flange 52 extends downwardly to a flange end 54 for receiving the lip 34 of the cup 22 within the flange 52 to define the assembled position of the drinking assembly 20 as best shown in FIG. 2.

Figure 7:
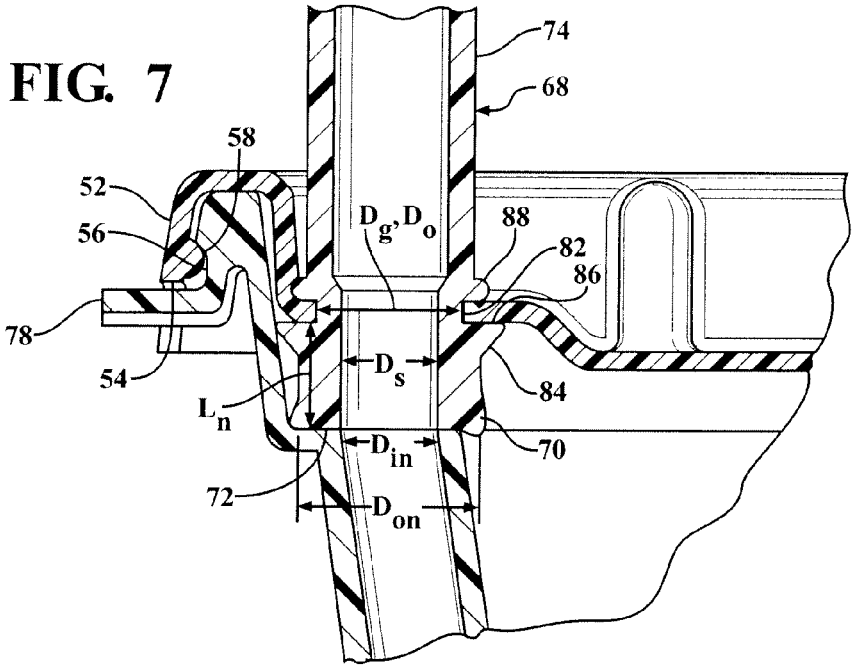
FIG. 7 is a magnified view of a portion of FIG. 6 illustrating a nipple portion of the flexible straw disposed in abutting relationship with the integral straw to establish a compression fit in the assembled position.

As best shown in FIG. 7, when the cup 22 and the lid 24 are mated together in interlocking relationship, the flange 52 of the lid 24 and the lip 34 of the cup 22 interact to provide a spill-proof and a leak-proof design of the drinking assembly 20. In a preferred embodiment, the mouth portion 32 defines a recess 56 disposed circumferentially below the lip 34 of the cup 22 and the flange 52 of the lid 24 includes a projection 58 extending inwardly from the flange end 54 and disposed within the recess 56 of the mouth portion 32 in the assembled position for establishing this mechanical interlocked relationship.

As best shown in FIGS. 1 and 3, the lid 24 includes a cavity 60 extending downwardly from the top surface 46 and along a cavity axis A from a first end 62 to a second end 64. The cavity 60 defines an orifice 66 having an orifice diameter $D_o$ disposed about the second end 64 and aligned on the cavity axis A. A flexible straw 68 is disposed within the orifice 66 and has a nipple portion 70 extending to an inlet end 72 disposed in abutting relationship with the integral straw 36 in the assembled position to establish a compression fit between the flexible straw 68 and the integral straw 36 for sealing fluid communication therebetween. In the preferred embodiment, the nipple portion 70 is elastic and preferably made of silicone rubber, however any other comparable material may be used to establish the compression fit. The flexible straw 68 also includes a straw portion 74 extending from the nipple portion 70 to an outlet end 76, and the compression fit establishes a leak-proof design between the flexible straw 68 and the integral straw 36 which ensures that the straws 36, 68 form a unitary and sealed straw that extends from the lower portion of the integral straw 36 to the outlet end 76 of the flexible straw 68 for allowing sealed fluid communication therebetween. In the preferred embodiment, the flexible straw 68 is one piece, and thus the straw portion 74 is comprised of the same material as the nipple portion 70, namely silicone rubber. However, a separate comparable material can be used for the straw portion 74. Also, as best shown in FIG. 7, in the preferred embodiment the integral straw 36 is cylindrical to define an integral straw diameter $D_s$ and the nipple portion 70 is cylindrical to define an inner nipple diameter $D_{in}$ being smaller or equal to the integral straw 36 diameter and an outer nipple diameter $D_{on}$ sized larger than the integral straw 36 diameter $D_s$ for surrounding the integral straw 36 with the inlet end 72 of the nipple portion 70 to establish the compression fit of the straws 36, 68. However, the integral straw 36 and nipple portion 68 can take on a variety of shapes to accomplish the compression fit between the straws 36, 68. In addition, in the preferred embodiment, an alignment tab 78 extends from the recess 56 and is adjacent and aligned with the integral straw 36. The flange 52 also defines a notch 80 extending upwardly from the flange end 54 and aligned with the orifice 66 and the cavity axis A. This arrangement of the alignment tab 78 and notch 80 is advantageous because the notch 80 receives the alignment tab 78 in the assembled position to ensure that the orifice 66 is aligned with the integral straw 36 to provide an accurate compression fit with the nipple portion 70 of the flexible straw 68.

As best shown in FIG. 7, the flexible straw 68 defines a groove 82 extending inwardly and circumferentially about the nipple portion 70 to define a groove 82 diameter $D_g$ equal to the orifice diameter $D_o$ for seating the flexible straw 68 within the orifice 66 in the assembled position. In addition, the flexible straw 68 includes a locking tab 84 extending outwardly from the nipple portion 70 between the groove 82 and the inlet end 72 to define an annular shoulder 86 for engaging the lid 24 in the assembled position to prevent the nipple portion 70 from exiting the orifice 66. In other words, when the lid 24 and the cup 22 are disposed in the assembled position, the annular shoulder 86 prevents the flexible straw 68 from backing out or exiting the orifice 66 as a result of a force applied by the upper portion of the integral straw 36 to the inlet end 72 of the flexible straw 68. Therefore, the annular shoulder 86 is advantageous because it establishes an opposing and resistant force in the assembled position that helps to establish the compression fit between the straws 36, 68 and ensures sealed fluid communication therebetween. The flexible straw 68 also includes an annular rib 88 extending outwardly from the nipple portion 70 between the groove 82 and the straw portion 74 for engaging the top surface 46 of the lid 24 in the assembled position to further secure and retain the flexible straw 68 within the orifice 66.

Figure 4:
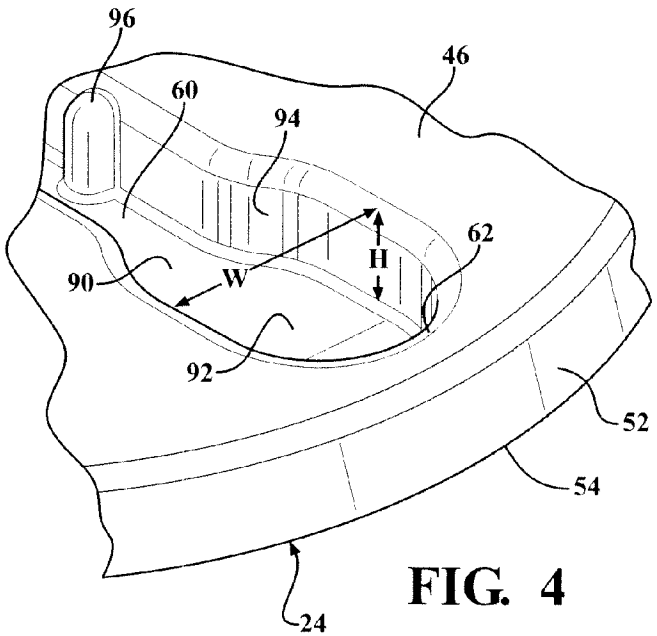
FIG. 4 is a magnified view of a portion of FIG. 3 illustrating an open portion of a cavity of the lid.
Figure 8A:
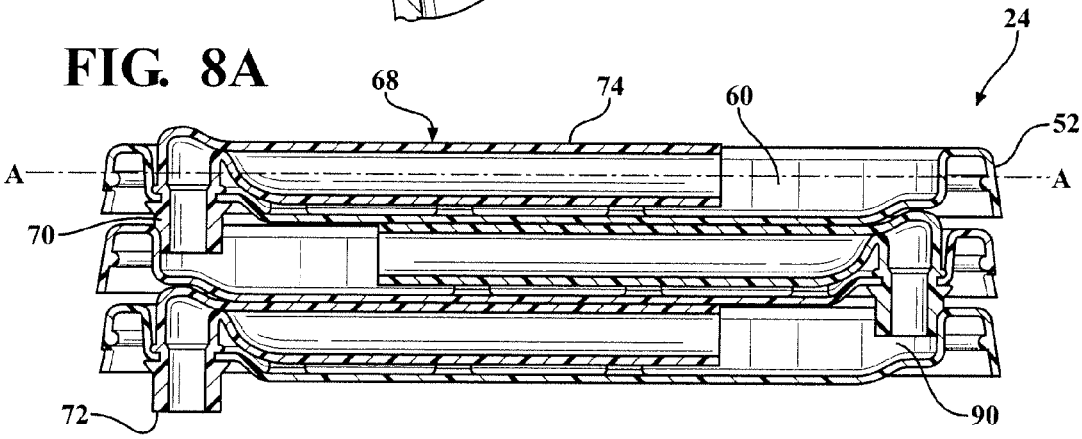
FIG. 8 is a cross sectional view of the lids disposed in the stacking relationship and illustrating the nipple portion disposed in the open portion of the cavity of an identical stacked lid.
Figure 8B:
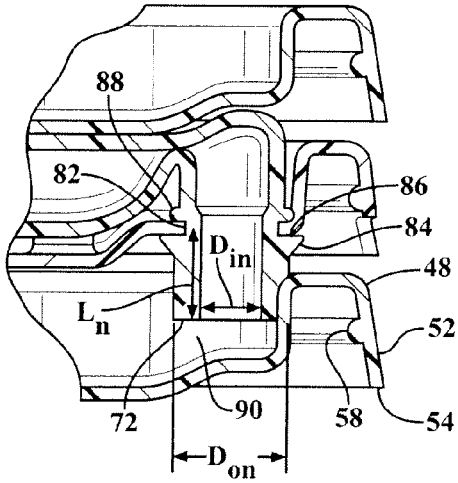

As best shown in FIGS. 3 and 8, in a preferred embodiment the lid 24 can be a stackable lid 24 for abutting and stacking with identical lids 24. In this embodiment, the cavity 60 has an open portion 90 disposed about the second end 64 for receiving a nipple portion 70 of the identical lid 24 being stacked in 180 degree alternating relationship. In other words, when the lids 24 are disposed in stacking relationship, the nipple portion 70 of the stacked lid 24 extends downwardly into the open portion 90 of an identical lid 24 stacked directly below such that the orientation of each lid 24 is rotated 180 degrees from each adjacent stacked lid 24. This arrangement is advantageous because the stacking of the lids 24 in alternating orientation saves space for shipping purposes. In this embodiment, as best shown in FIGS. 7 and 8, the nipple portion 70 defines a nipple length $L_n$ extending between the orifice 66 and the inlet end 72. In addition, as best shown in FIG. 4, the cavity 60 extends from the top surface 46 to a cavity surface 92 to define a cavity wall 94 having a cavity wall height H being larger than the nipple length $L_n$. As best shown in FIG. 8, these dimensions allow the cavity surface 92 to be disposed in spaced relationship with the nipple portion 70 of the identical stacked lid 24.

As best shown in FIG. 2, the cavity 60 defines a cavity length $L_c$ extending along the axis A from the first end 62 to the second end 64. In addition, as best shown in FIG. 1, the straw portion 74 has a straw length $L_s$ extending from the nipple portion 70 to the outlet end 76 being less than the cavity length $L_c$. As best shown in FIG. 3, the flexible straw 68 is also bendable to establish a stored position of the flexible straw 68 defined by the straw portion 74 being disposed within the cavity 60 and along the axis A. In the preferred embodiment, the straw portion 74 is cylindrical to define a straw diameter $D_s$ being less than or equal to the cavity wall height H for storing the flexible straw 68 below the top surface 46 in the stored position. This design is advantageous because when the identical lids 24 are disposed in stacking relationship, the flexible straw 68 can be stored below the top surface 46 to prevent the flexible straw 68 from abutting a cavity surface 92 of the identical stacked lid 24. In addition, a plurality of ribs 96 extend inwardly from the cavity wall 94 in spaced and aligned relationship about the cavity 60 axis A for securing the removable straw in the stored position to prevent the straw from inadvertently being removed from the stored position. In the preferred embodiment, the open portion 90 of the cavity 60 also has an open portion width W sized larger than the straw diameter $D_s$ for providing access to the outlet end 76 of the flexible straw 68 in the stored position. The open portion 90 thus allows a user to remove the flexible straw 68 from the stored position and bend the straw back to a drinking position which allows the user to drink the fluid through the integral straw 36 and the flexible straw 68.

Obviously, many modifications and variations of the present invention are possible in light of the above teachings and may be practiced otherwise than as specifically described while within the scope of the appended claims. These antecedent recitations should be interpreted to cover any combination in which the inventive novelty exercises its utility. The use of the word "said" in the apparatus claims refers to an antecedent that is a positive recitation meant to be included in the coverage of the claims whereas the word "the" precedes a word not meant to be included in the coverage of the claims.

What is claimed is:

1. A drinking assembly comprising;

a cup including a base and a wall extending upwardly from said base for receiving a fluid, said cup including an integral straw integrally disposed with said wall and extending from a lower end to an upper end for conveying the fluid from said base, a lid including a locking mechanism for mating with said cup to establish an assembled position of said drinking assembly, said lid defining an orifice aligned with said integral straw in said assembled position, a flexible straw disposed within said orifice and having a nipple portion extending to an inlet end disposed in abutting relationship with said upper end of said integral straw in said assembled position; and said flexible straw including a locking tab engaged with said lid in said assembled position to prevent said flexible straw from exiting said orifice and establish a compression fit between said abutting ends of said straws for sealing fluid communication therebetween.

2. A drinking assembly as set forth in claim 1, wherein said flexible straw defines a groove for seating said flexible straw within said orifice.

3. A drinking assembly as set forth in claim 2, wherein said locking tab extends outwardly from said nipple portion between said groove and said inlet end to define an annular shoulder for engaging said lid in said assembled position to prevent said flexible straw from exiting said orifice.

4. A drinking assembly as set forth in claim 3, wherein said flexible straw includes an annular rib extending outwardly from said nipple portion and disposed adjacent said groove and opposite said locking tab for engaging said lid in said assembled position to further retain said flexible straw within said orifice.

5. A drinking assembly as set forth in claim 1, wherein said lid includes a cavity extending along a cavity axis and said flexible straw having a straw portion extending from said nipple portion and being bendable to establish a stored position of said flexible straw defined by said straw portion disposed within said cavity and along said cavity axis.

6. A drinking assembly as set forth in claim 5, wherein said cavity extends from a first end to a second end to define a cavity length and said straw portion extends from said nipple portion to an outlet end to define a straw length being less than said cavity length.

7. A drinking assembly as set forth in claim 5, further including a plurality of ribs disposed within said cavity for securing said removable straw in said stored position.

8. A drinking assembly as set forth in claim 5, wherein said straw portion being cylindrical to define a straw diameter and said cavity including an open portion disposed about said first end and having an open portion width sized larger than said straw diameter for providing access to said outlet end of said flexible straw in said stored position.

9. A drinking assembly as set forth in claim 1, further including;

said wall of said cup extending upwardly from said base to a lip, said lid including a top surface, and said locking mechanism including a flange extending downwardly from said top surface to a flange end for receiving said lip within said flange in said assembled position.

10. A drinking assembly as set forth in claim 9, wherein said cup includes a recess disposed below said lip and said flange includes a projection extending inwardly from said flange end and disposed within said recess for establishing mechanical interlocking relationship between said lip and said cup in said assembled position.

11. A drinking assembly as set forth in claim 1, wherein said cup includes an alignment tab disposed in aligned relationship with said integral straw and said lid defines a notch disposed in aligned relationship with said orifice for receiving said alignment tab in said assembled position to establish said aligned relationship between said orifice and said integral straw.

* * * * *